United States Patent [19]

Ciccone et al.

[11] 3,983,818

[45] Oct. 5, 1976

[54] INCENDIARY TRACER PROJECTILE

[75] Inventors: Thomas Q. Ciccone, Ocean City, N.J.; Thomas McNally, Levittown, Pa.; William E. Perkins, Runnemede, N.J.

[73] Assignee: The United States of America as represented by the Secretary of the Army, Washington, D.C.

[22] Filed: Mar. 31, 1975

[21] Appl. No.: 563,547

[52] U.S. Cl. ..... 102/60; 102/66; 102/87; 149/19.4; 149/76; 149/100

[51] Int. Cl.[2] ..... F42B 13/34

[58] Field of Search ..... 149/19.4, 100, 76; 102/60, 87, 66

[56] References Cited

UNITED STATES PATENTS 3,370,536 2/1968 Francis et al. ..... 102/66

3,702,792 11/1972 Nolte et al. ..... 149/100 X

*Primary Examiner*—Stephen J. Lechert, Jr.

*Attorney, Agent, or Firm*—Nathan Edelberg; Robert P. Gibson; Arthur M. Suga

[57] ABSTRACT

Incendiary or flame projectile for use with conventional igniter-tracer systems and capable of being propelled over distances up to about 600 yards to ignite hard-to-ignite combustible materials such as wood or canvas, the projectile being operable and efficient at atmospheric pressures and containing a flame-producing composition similar to gas generator propellants of double-base or ammonium perchlorate formulations.

8 Claims, 1 Drawing Figure

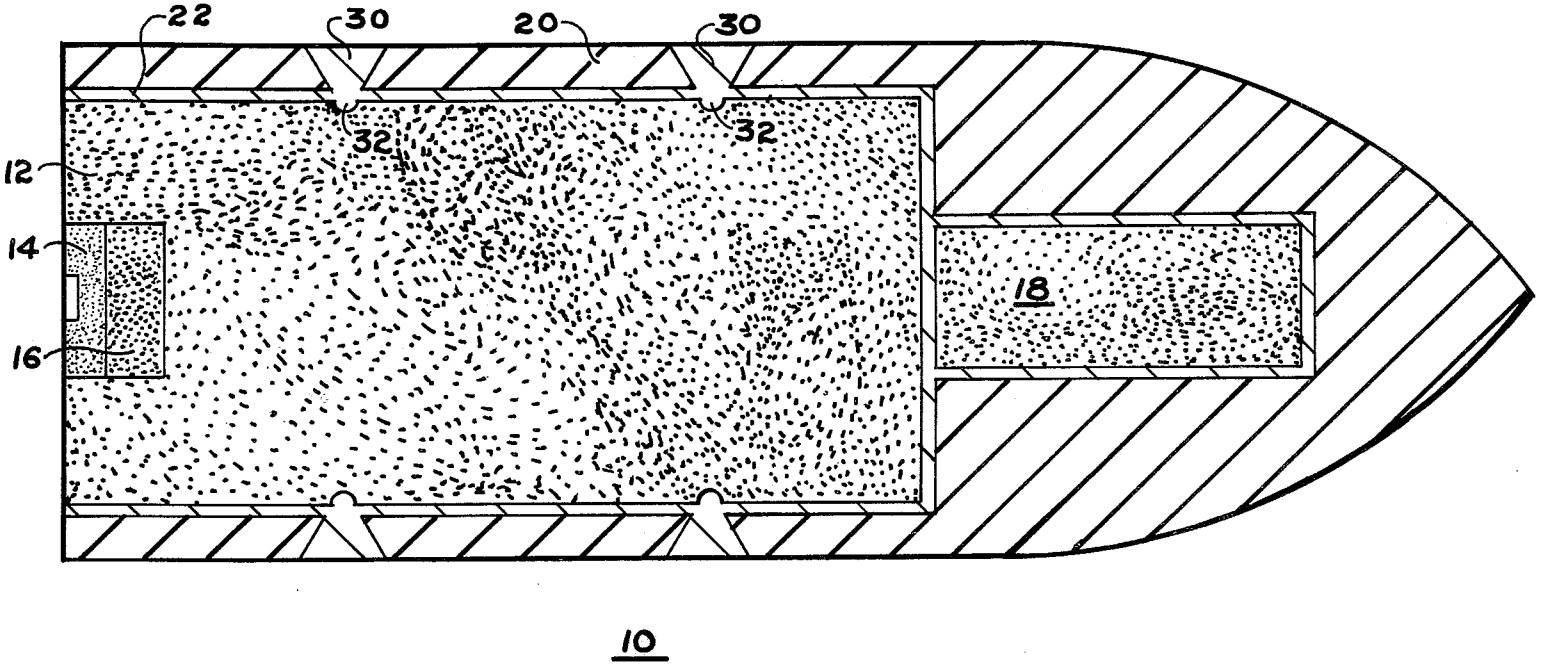
22
30
32
20
30
32
12
14
16
18
10

INCENDIARY TRACER PROJECTILE

The invention described herein may be manufactured, used and licensed by or for the Government for governmental purposes without the payment to us of any royalty thereon.

This invention relates to incendiary projectiles and more particularly concerns such a projectile for reliably igniting targets which are not readily ignitable and at an uncomfortable distance away.

Particularly in times of war or armed agression, it may be desirable or essential to ignite wooden structures, vehicles, foodstuffs, or even highly combustible materials such as petroleum products, explosives, and the like, from a distant point because of tactical or military reasons, or physical inaccessibility of the target. In many such situations, flame throwers have proved effective. Their efficiency however decreased significantly as the distance to the target increased, and in various instances where the distance to the target was in excess of about 200 yards, little or no damage could be inflicted.

Where the targets were more than about 200 yards distant, incendiary projectiles were often employed. However, due to extremely short burst duration of these projectiles of only a few milliseconds, targets not easily ignitable remained unharmed.

Wooden structures, canvas, and the like, require flames of high temperature lasting for several seconds if ignition is to be sustained. Pyrotechnic compositions ignited by a point-detonating fuse were found generally undesirable because only a relatively small percentage could be successfully actuated, and then, only against hard targets. Similarly, combustible projectiles were found to provide only limited success even under selected target conditions. Their compositions were stoichiometrically unbalanced, i.e., fuel rich, and would not continue to burn when oxygen surrounding the projectile became deficient. And balanced compositions would burn much too rapidly for applications contemplated by this invention.

Gasoline gels and gasoline capsules, when fired in projectiles to be propelled from weapon chambers having pressures in the range of 2000 to 4000 psi, not only pose severe weapon design problems, but flame temperatures produced therefrom were generally too low to ignite desired targets.

It is therefore an object of this invention to provide improved flame or incendiary projectiles which will yield sufficiently high flame temperatures for a sufficient duration to ignite hard-to-ignite combustible materials.

Other objects and advantages of our invention will be apparent upon reference to the description which follows when taken in conjunction with the drawing which shows a sectional view of an embodiment of the invention.

Briefly, we have discovered that the application of gas generator type propellant grains to a tracer-ignition system will produce high flame temperatures in a projectile system which will be of sufficient duration to ignite hard-to-ignite combustible materials.

More specifically, gas generator type propellants of both double-base and composite (ammonium perchlorate) types were adapted to a 40 mm projectile system, although not limited thereto, to provide an incendiary projectile capable of igniting hard-to-ignite combustible materials.

Referring now to the single FIGURE, projectile 10 is positioned in a 40 mm cartridge, for example, (not shown) the projectile including a flame-producing composition 12. When the cartridge is fired, the propellant gas resulting therefrom will ignite igniter 14, which ignites long burning tracer 16, which, in turn, ignites the flame-producing component 12. Flame-producing composition 12 will end burn (cigarette fashion) to produce a high temperature, long-duration flame until surface of a special effects component 18 is reached. The proper contour for the projectile is maintained by container 20, preferably polyethylene, and to which a sealant 22, suitably an epoxy resin, firmly holds flame-producing composition 12 thereto.

Spaced grooves 30, two of which are shown transversely encircling the projectile, in cooperation with mating circumferential grooves 32 in flame-producing composition 12, also have sealant material 22 disposed therein for added rigidity. Sealant 22 thus forms one continuous bond between the flame-producing component and the polyethylene container.

Our flame-producing composition may be a double-base formulation:

| | |
|---|---|
| Nitrocellulose (12.6%N) | 57.0% (wt.) |
| Nitroguanidine | 22.8 |
| Diphenylamine (stabilizer) | 3.1 |
| Dibutyl phthalate (plasticizer) | 17.1 |

or composite type:

| | |
|---|---|
| Ammonium perchlorate | 75.0% (wt.) |
| Polyester styrene (liquid) | 23.5 |
| Cure catalyst, as Toluene di-isocyanate | 1.5 |

or other gas generator type propellants which burn at about one inch per minute at atmospheric pressures.

The igniter material 14 may be:

| | |
|---|---|
| Magnesium | 14.1% (wt.) |
| Barium peroxide | 78.3 |
| Chlorinated rubber polyisoprene | 5.6 |
| Toluidene red | 1.0 |
| Zinc stearate | 1.0 |

and the tracer formulation 16 will preferably be a slow-burning composition such as:

| | |
|---|---|
| Magnesium | 23.4% (wt.) |
| Strontium nitrate | 33.5 |
| Potassium perchlorate | 16.7 |
| Manganese dioxide | 4.0 |
| Strontium oxalate | 6.7 |
| Dechlorane | 2.8 |
| Calcium resinate | 3.3 |
| Oxamide | 9.6 |

Polyethylene has been found most suitable for the 40 mm container. In actual tests, the polyethylene container was found to be burning for several minutes after the flame-producing component had been entirely consumed. Of course, other suitable container materials could be used, depending on the target, and alternate methods of adhering the flame-producing component to the container might be desirable.

The special effects component 18 could suitably be a standard flash-producing composition, but other effects, such, for example, as an explosive, or even an additional length of flame-producing composition having a smaller diameter, could advantageously have been employed.

A standard flash-producing composition or primer mix may be:

| | |
|---|---|
| Barium nitrate | 20 parts |
| Lead dioxide | 20 parts |
| PETN | 20 parts |
| Metallic Zirconium | 40 parts, subdivided: |
| 7.5 parts, 3-5 microns | |
| 32.5 parts, approximately 150 microns, average size | |

Some examples of our incendiary projectiles in a polyethylene container using epoxy resin, when fired in a 40 mm cartridge are:

EXAMPLE I

| | |
|---|---|
| Double base propellant abovedescribed | 15.0g |
| Igniter composition abovedescribed | 0.5g |
| Tracer formulation abovedescribed | 2.0g |
| Special effects formulation (additional double base propellant abovedescribed) | 3.0g |
| Target ignited and ignition sustained | Wooden shack |
| Distance to target | 600 yds. |
| Flame Temperature (at 1000 psia) | 2000°F |
| Specific Impulse | 200 lb. force-sec/lb. mass |

EXAMPLE II

Same as above, except target ignited and ignition sustained: Canvas tent

EXAMPLE III

| | |
|---|---|
| Ammonium perchlorate propellant abovedescribed | 10.0g |
| Igniter composition abovedescribed | .5g |
| Tracer formulation abovedescribed | 2.0g |
| Special effects formulation (additional AP propellant abovedescribed) | 8.0g |
| Target ignited and ignition sustained | Wooden shack |
| Distance to target | 600 yds. |
| Flame Temperature (at 1000 psia) | 3760°F |
| Specific Impulse | 225 lb. force-sec/lb mass |

EXAMPLE IV

Same as above, except target ignited and ignition sustained: Canvas tent

It is apparent from the foregoing description that we have provided an improved flame or incendiary projectile which provides a high flame temperature of sufficient duration to ignite wood, canvas, or other hard-to-ignite combustible materials at distances up to about 600 yards. Although gas generator propellants are not considered useable at atmospheric pressures, our igniter-tracer system projectile, when configured as illustrated, and including the gas generator type propellants as claimed and described, was not only useable but highly efficient at atmospheric pressures to ignite hard-to-ignite combustible materials.

We claim:

1. In a projectile having an igniter-tracer system therein, the improvement therewith comprising a flame-producing composition communicating with said igniter-tracer system for providing propulsion of an incendiary projectile up to a distance of about 600 yards and yet burning with a high temperature over an extended duration to ignite hard-to-ignite combustible materials such as wood and canvas, said flame-producing composition consisting of, by weight:

| | |
|---|---|
| Nitrocellulose (12.6%N) | 57.0% |
| Nitroguanidine | 22.8 |
| Diphenylamine | 3.1 |
| Dibutyl phthalate | 17.1. |

2. In a projectile having an igniter-tracer system therein, the improvement therewith comprising a flame-producing composition communicating with said igniter-tracer system for providing propulsion of an incendiary projectile up to a distance of about 600 yards and yet burning with a high temperature over an extended duration to ignite hard-to-ignite combustible materials such as wood and canvas, said flame-producing composition consisting of, by weight:

| | |
|---|---|
| Ammonium perchlorate | 75.0% |
| Polyester styrene (liquid) | 23.5 |
| Toluene di-isocyanate | 1.5. |

3. The incendiary projectile described in claim 1 wherein said projectile includes a polyethylene container and said flame-producing composition is fixedly adhered to said container by means of a plurality of spaced transverse grooves disposed around periphery of said container and a corresponding number of spaced grooves in said flame-producing composition aligned with said container grooves, and a sealant material disposed within all of said grooves for additionally securing said flame-producing composition to said container.

4. The incendiary projectile described in claim 2 wherein said projectile includes a polyethylene container and said flame-producing composition is fixedly adhered to said container by means of a plurality of spaced transverse grooves disposed around periphery of said container and a corresponding number of spaced grooves in said flame-producing composition aligned with said container grooves, and a sealant material disposed within all of said grooves for additionally securing said flame-producing composition to said container.

5. The incendiary projectile described in claim 3 wherein said sealant is an epoxy resin.

6. The incendiary projectile described in claim 4 wherein said sealant is an epoxy resin.

7. The incendiary projectile of claim 5 wherein a special effects component within said container is axially forwardly said flame-producing composition and of lesser diameter than said flame-producing composition while in communicating relation thereto, said special effects component comprising an ignitable material selected from the group consisting of flash-producing compositions and flame-producing compositions.

8. The incendiary projectile of claim 6 wherein a special effects component within said container is axially forwardly said flame-producing composition and of lesser diameter than said flame-producing composition while in communicating relation thereto, said special effects component comprising an ignitable material selected from the group consisting of flash-producing compositions and flame-producing compositions.

* * * * *